US008091305B2

(12) United States Patent
Skeeter

(10) Patent No.: US 8,091,305 B2
(45) Date of Patent: Jan. 10, 2012

(54) RECYCLED GLASS STRUCTURAL AND DECORATIVE BARRIER OR BUILDING, LIGHTING AND FURNITURE COMPONENT

(76) Inventor: Jane A. Skeeter, West Hills, CA (US)

( * ) Notice: Subject to any disclaimer, the term of this patent is extended or adjusted under 35 U.S.C. 154(b) by 171 days.

(21) Appl. No.: 12/395,563

(22) Filed: Feb. 27, 2009

(65) Prior Publication Data

US 2010/0221565 A1 Sep. 2, 2010

(51) Int. Cl.

| | |
|---|---|
| ***E04F 13/00*** | (2006.01) |
| ***E04F 15/00*** | (2006.01) |
| ***E04F 19/00*** | (2006.01) |
| ***E04F 15/06*** | (2006.01) |

(52) U.S. Cl. ..... 52/311.1; 52/311.2; 52/311.3; 52/315; 52/745.19; 52/660

(58) Field of Classification Search ..... 52/311.1, 52/311.2, 311.3, 315, 745.19, 741.1, DIG. 9, 52/660, 664; 428/542.2; 65/28
See application file for complete search history.

(56) References Cited

U.S. PATENT DOCUMENTS

| | | | | | |
|---|---|---|---|---|---|
| 1,852,274 | A | * | 4/1932 | Thurn | 52/311.3 |
| 3,076,294 | A | * | 2/1963 | Schiessl | 428/38 |
| 4,068,429 | A | * | 1/1978 | Moore | 52/210 |
| 4,194,329 | A | | 3/1980 | Wendt | |
| 4,653,243 | A | * | 3/1987 | Burkett | 52/741.4 |
| 5,335,472 | A | * | 8/1994 | Phillips | 52/742.14 |
| 5,379,564 | A | | 1/1995 | Wynne | |
| 5,516,351 | A | * | 5/1996 | Solomon et al. | 65/17.4 |
| 5,522,194 | A | * | 6/1996 | Graulich | 52/309.4 |
| 5,555,698 | A | * | 9/1996 | Mandish | 52/745.17 |
| 5,724,783 | A | * | 3/1998 | Mandish | 52/745.05 |
| 5,829,915 | A | * | 11/1998 | Andreassen | 405/18 |
| 5,833,907 | A | * | 11/1998 | Uchida et al. | 264/245 |
| 5,906,081 | A | * | 5/1999 | Mantyla | 52/344 |
| 5,950,936 | A | * | 9/1999 | Bergart | 241/21 |
| 6,185,892 | B1 | * | 2/2001 | Calvanella | 52/311.1 |
| 6,708,751 | B1 | * | 3/2004 | Shulman | 160/372 |
| 6,718,722 | B2 | * | 4/2004 | Worrell et al. | 52/741.13 |
| 6,817,146 | B2 | * | 11/2004 | Jasperson | 52/204.59 |
| 2002/0085884 | A1 | * | 7/2002 | Harris | 405/154.1 |
| 2004/0067352 | A1 | * | 4/2004 | Hagerman et al. | 428/304.4 |
| 2005/0286980 | A1 | * | 12/2005 | Hilfiker | 405/262 |
| 2006/0179880 | A1 | * | 8/2006 | Haun | 65/23 |
| 2007/0203262 | A1 | * | 8/2007 | Crossley | 523/214 |
| 2008/0185565 | A1 | * | 8/2008 | Major et al. | 256/35 |

FOREIGN PATENT DOCUMENTS

| | | |
|---|---|---|
| JP | 2007-037414 | 2/2007 |

* cited by examiner

*Primary Examiner* — Eileen D Lillis
*Assistant Examiner* — Mark Wendell
(74) *Attorney, Agent, or Firm* — Koppel, Patrick, Heybl & Philpott; Michael J. Ram

(57) ABSTRACT

A decorative structure comprises a frame completely surrounding a space and a front and rear barrier material applied to front and rear surfaces of the frame enclosing the space to form a three dimensional structure. The space located between the front and rear barrier material and the frame, is filled with pieces of waste glass, or other recycled material, which has been processed to have smoothened surfaces and provide a decorative appearance. At least the front barrier material has sufficient transparency so that the decorative appearance of the waste material held behind the barrier is visible.

16 Claims, 3 Drawing Sheets

RECYCLED GLASS STRUCTURAL AND DECORATIVE BARRIER OR BUILDING, LIGHTING AND FURNITURE COMPONENT

Disclosed herein is a new structural and decorative panel for use in both interior and exterior architectural design and construction applications. The panel includes a decorative display of recycled glass and allows an enormous amount of waste architectural glass to be diverted from disposal in landfill. Applications include, but are not limited to, barriers, wall decorations, lighting or furniture components, artistic displays, water features and entry ways.

BACKGROUND

While a system has been established for the collection and recycle of glass bottles and containers from domestic waste, a cost effective and useful arrangement has not been established for the recovery and reuse of structural glass typically used in construction. In particular, to recycle waste glass from window, door and shower enclosure manufacturers and local glass fabricators the glass is typically transported great distances to be re-melted (with huge energy consumption) and then redistributed, again requiring transportation for great distances to a new end user for incorporation in glass sheet fabrication or land fill applications. This is a different type of glass than bottle and container glass, the latter is already being widely recycled.

BRIEF DESCRIPTION

Described herein is a method of addressing this costly waste recovery issue and at the same time providing both structural and decorative products using this waste material. In particular, the industrial or commercial waste glass is collected, for local processing by breaking and tumbling or other polishing techniques to produce suitably sized pieces of glass with the sharp edges removed and an enhanced surface appearance. This processed glass is then used as a loose filler in an interior space within a suitable retaining structure such as a three dimensional panel arrangement composed of two substantially parallel transparent or translucent barriers, preferably comprising a mesh structure, held within a frame. As an alternative embodiment, a binding agent can be added to the loose filler to form a more cohesive or substantially solid space filler.

DESCRIPTION OF THE DRAWINGS

Referring to the drawings forming an integral part of this specification.

DETAILED DESCRIPTION

Figure 1:
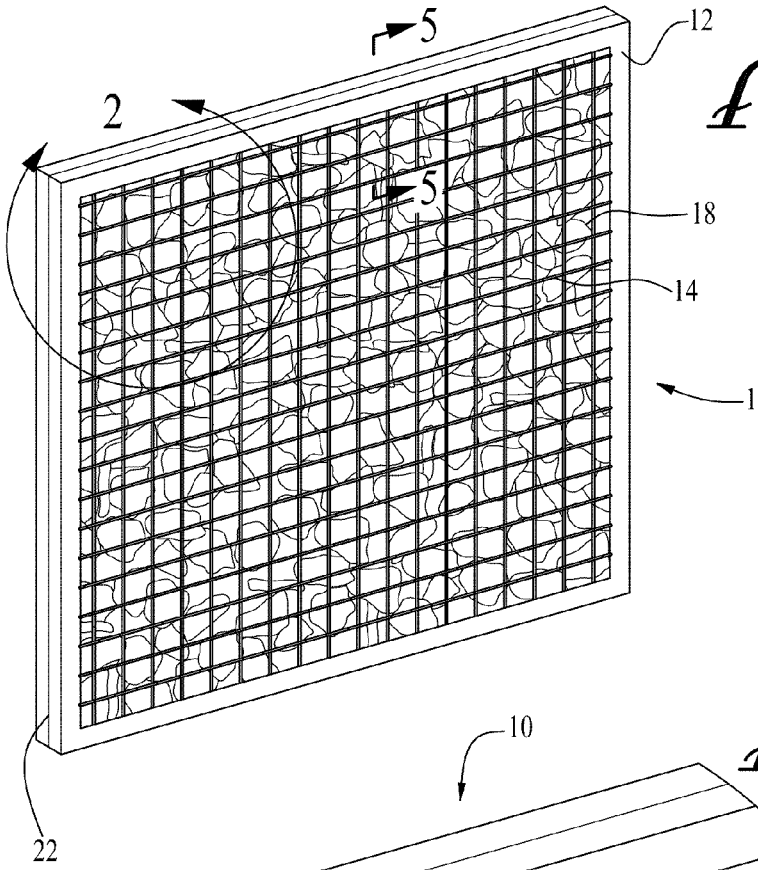
FIG. 1 is a front perspective view of a product incorporating features of the invention.
Figure 2:
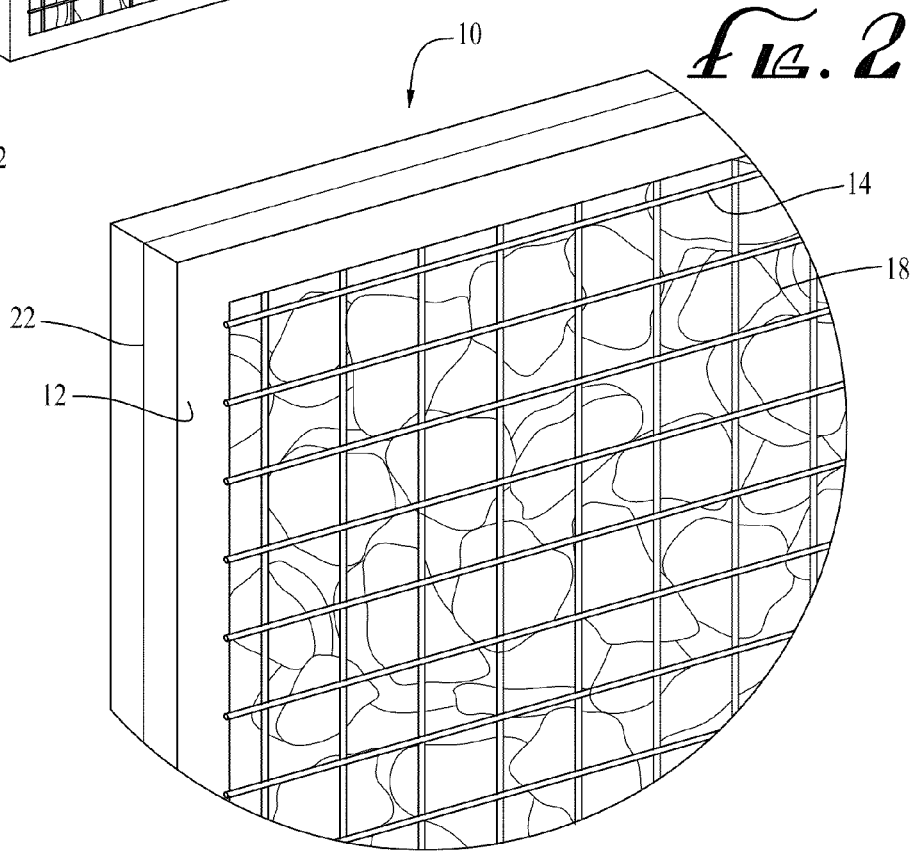
FIG. 2 is and enlarged front view of the circled portion of FIG. 1.
Figure 5:
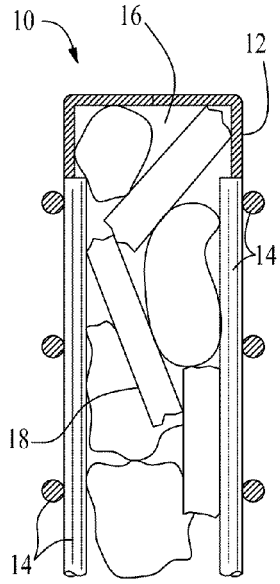
FIG. 5 is a cross sectional view taken along line 5-5 of FIG. 1.

Referring to the Figures, FIG. 1 shows a decorative panel 10, which can be used as a structural element, incorporating features of the invention which comprises a frame 12 with a mesh or other suitable barrier 14 on the front and rear of the frame capable of retaining in a space 16 therebetween a filler 18 as described herein below. A typical panel comprises a box approximately 4 foot by 4 foot with a thickness of about 2 inches to about 4 inches. However, the dimension are not critical to the invention and smaller (for example 1 foot by 2 foot or 2 foot by 2 foot) or larger (for example 8 foot by 8 foot) panels with a smaller or larger interior space 16 incorporating features of the invention can be constructed. The dimensions of the panel 10 and the barrier 14 openings are typically selected based on the end application of the structure, the weight of the assembled panel and the size of the filler material 18. FIG. 1 illustrates an embodiment having a structural steel frame 12 with a barrier 14, comprising a wire mesh, forming the front and rear surfaces of the panel 10. The internal space 16, i.e., the area between front and rear barriers 14, is filled with randomly distributed tumble polished waste glass as best shown in FIG. 5, which is a cross sectional view taken along line 5-5 of FIG. 1. The frame 12 provides the strength necessary for use as a structural component. The tumbled glass filler 18 provides a decorative means of using recycled glass. The glass filler material 18 is loose within the frame and preferably not adhesively attached, melted to attach adjacent pieces, or secured by any liquid or molten plastic filler. FIG. 2 is an enlarged image of the circled portion of FIG. 1. While not shown, other filler materials may also be added.

The various embodiments provide means to recycle, repackage, re-use, and redistribute waste glass as both interior and exterior architectural design features. A significant quantity of waste architectural glass is thus diverted from disposal in a landfill. The filler is typically glass having a thickness greater than container glass which is discarded during the manufacture of large glass products as well as during the fabrication of windows, doors, shower enclosures or other structural/architectural glass products. It is preferably a type of glass which is different from bottle and container glass that is already being widely recycled. Virtually all types and thicknesses of architectural glass may be acquired, mostly from various sources listed above, and fractured or broken into chunks of various sizes. These chunks are then frosted, typically by tumbling or sand blasting. The glass can then be further polished or otherwise treated such as by application of a coating to provide a smooth, reflective, multicolor, etc. surface or colorants may be added to produce an enhanced surface appearance. The processed glass is then used to fill prefabricated panel container structures specifically designed to hold the glass filler material. As an alternative, if larger chunks are desired, some of the fractured pieces may be adhesively or melt attached to create larger chunks. The processed waste glass filler 18 is intended to be the primary visual element while the frame 12 provides the structural integrity. The barrier 14 or mesh can provide both structural integrity and a visual element but it is intended primarily to retain the recycled glass filler 14 within the frame 12. The panels can be manufactured using wire mesh, examples of which are shown in the attached figures, or a wide variety of other types of materials, designed to contain the glass components in such a way as to permit the glass itself to be the primary visual element when viewed from the front and/or rear of the panel 10. Various standard and custom building component sizes and configurations are possible and intended. For example, while the figures show flat square panels, one skilled in the art will recognize that the panels can be fabricated with a wide range of geometric shapes as well as being curved or otherwise contoured.

Figure 3:
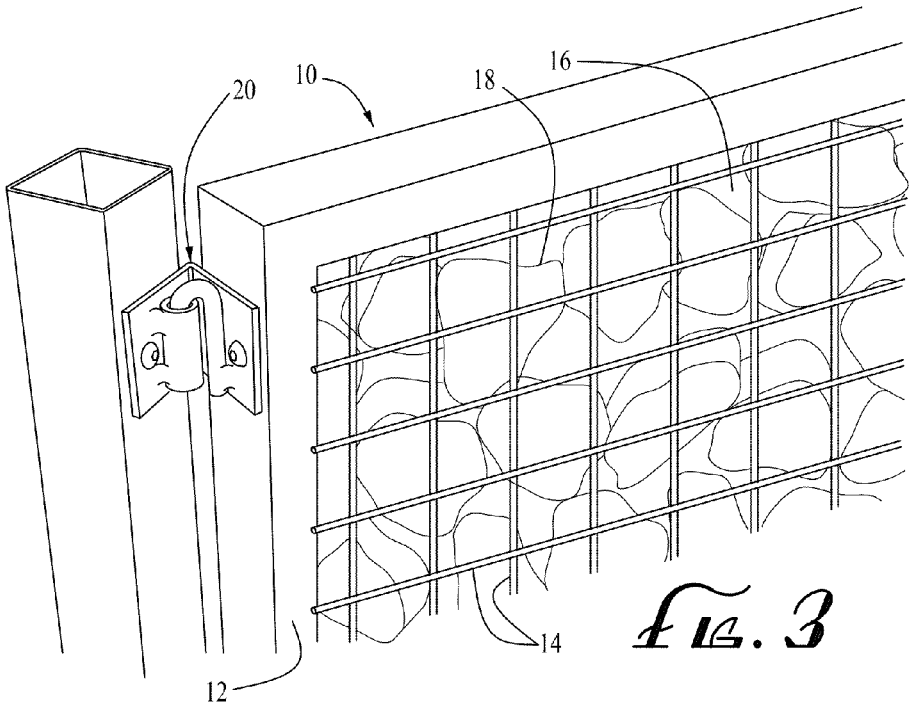
FIG. 3 is a perspective view of an upper portion of FIG. 1 including a hinge.
Figure 4:
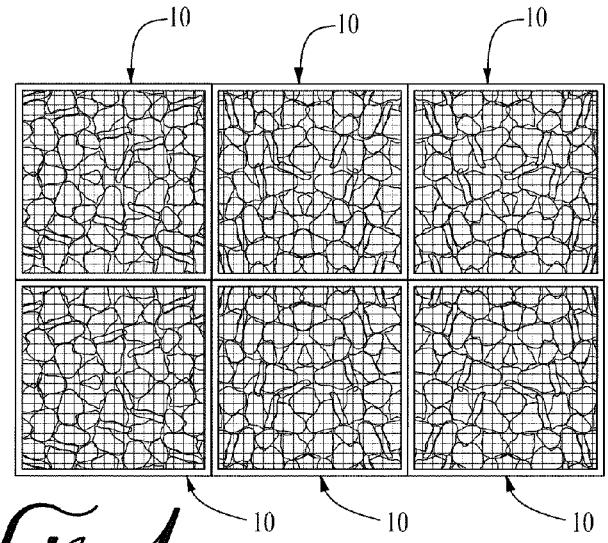
FIG. 4 is a front view showing multiple structures as shown in FIG. 1 joined together.

FIG. 3 shows an embodiment comprising a panel 10 such as shown in FIG. 1 with a hinge 20 attached to the frame 12 so that the panel 10 can be used as a gate or door. As a further embodiment, added structural integrity can be obtained by assembling multiple panels as shown for example in FIG. 4. One skilled in the art based on the teachings herein will understand that the multiple panels can be welded together, attached to each other by clamps and/or bolts (not shown) or set within a separate frame (not shown) designed to hold a panel together in its finished form or to mount multiple panels to together to form a larger structure.

Many applications are possible, including (but not limited to) architectural dividers, structural building components, signage, fences, gates, screens, barriers, walls, lighting, sculpture, art and water features, etc. For example, barriers incorporating features of the invention may be used to hide from view or camouflage other structures such as piping, waste collection areas, electrical panels, etc. While the figures show a wire mesh barrier 14 with approximately 1-2 inch openings, smaller or larger mesh sizes can be used, depending on the size of the glass filler material. Also, while a steel mesh is preferred, other metals or materials such as a plastic mesh or barrier can also be used. While the Figures show barriers with openings therein, it is also contemplated that the barrier may be a solid but transparent or translucent material which provides visualization of the filer material 18. The panels 10 may also include imaging enhancing components, such as lighting or flowing water sources, built into or applied to an exterior surface of the panel 10. Still further, the figures show both the front and rear barriers 14 to be an open mesh or otherwise transparent. However, it is further contemplated that one barrier 14, for example the rear barrier, may be solid or translucent while the other barrier may be an open mesh or different mesh patterns can comprise the front and rear barriers 14.

Figure 6:
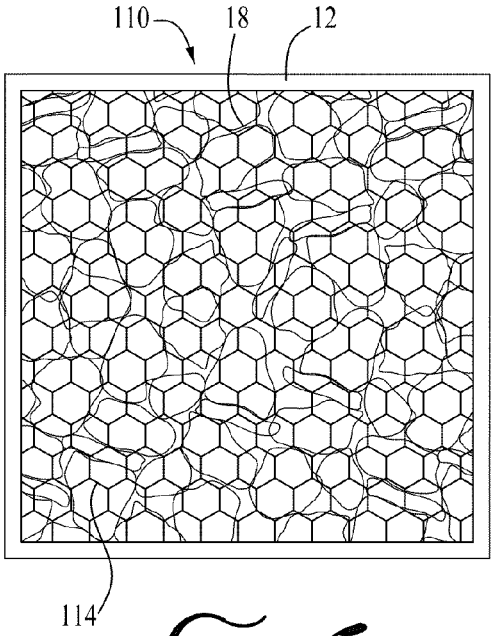
FIG. 6 shows a variation of the embodiment of FIG. 1 including a barrier comprising a mesh pattern with six-sided polygonal openings.
Figure 7:
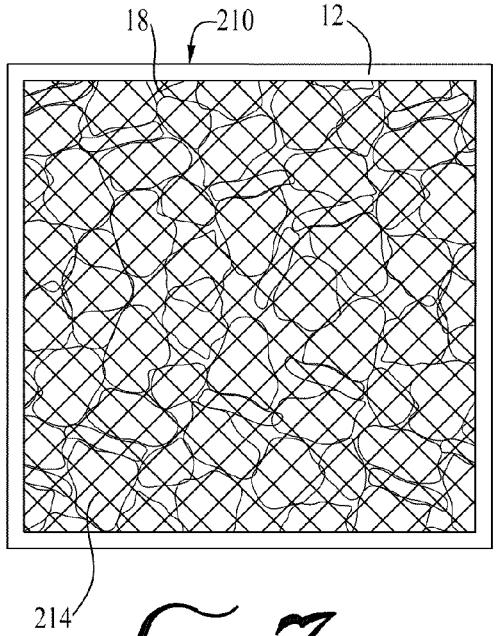
FIG. 7 shows a variation of the embodiment of FIG. 1 including a barrier comprising a mesh pattern with the wires in the mesh running diagonally.
Figure 8:
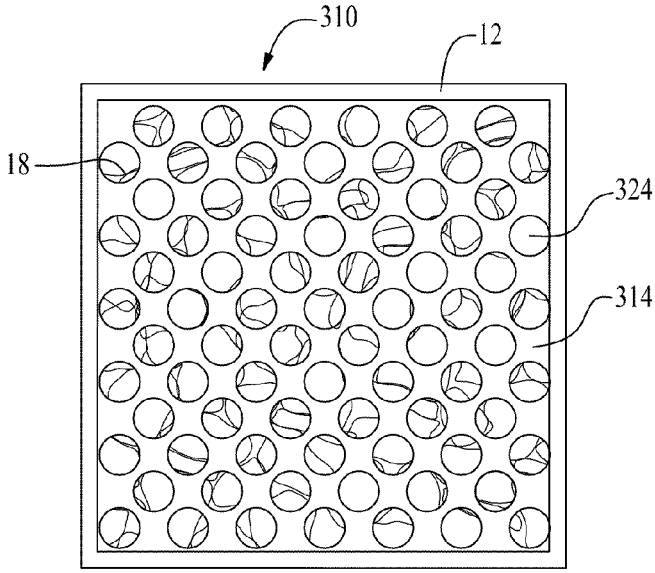
FIG. 8 shows a variation of the embodiment of FIG. 1 including a barrier with circular openings therein.

Still further as shown in FIGS. 6-8 the barrier 14 may be formed of a wide variety of mesh patterns or have various shaped openings. FIG. 6 shows a panel 110 with a mesh 114 having hexagonal openings in a pattern usually referred to as chicken wire. However, other geometric shaped openings can be used. Where FIG. 1 shows the wires comprising the mesh positioned horizontal and vertical to the frame 10, FIG. 7 shows a panel 210 with the a mesh 214 having the wires positioned diagonally within the frame 10, i.e., at an angle to the frame edge. FIG. 8 shows a panel 310 having a barrier 314 with a uniform distribution of multiple circular openings 324. Based on the teachings herein, one skilled in the art will recognize that a wide variety of barrier materials, openings and mesh designs can be used without straying from the intent of the invention disclosed herein.

One skilled in the art will recognize that the glass filled frames can be assembled using a variety of standard assembly techniques. For example, front and rear halves of the frame with attached barrier material can be fabricated. One half is then placed on a horizontal surface, the processed glass is placed within that half and the other side is attached sandwiching the glass between the front and rear frames. The interior edges of the frames can then be welded together along the seam 22 between the two halves, as shown in FIG. 1. Alternatively the front and rear halves can be bolted together or a edge piece (not shown) can be added to aid in attachment.

Alternatively the front and rear halves of the frame can be assembled with one mesh or one edge being left open. In either instance the glass filler is added and then the missing edge or mesh is attached using standard assembly techniques.

Accordingly, a decorative panel arrangement, which also can be used as a structural component, and examples of the assembly thereof have been described. The panel comprises a frame and front and rear transparent, translucent or opaque barriers attached thereto, the barriers allowing a filler material placed within the frame to be visualized. Waste glass that has been tumble polished or otherwise processed to enhance the exterior appearance thereof is used to fill the interior space within the panel. However, while the primary intent, as described herein is to use recovered glass material, it is also contemplated that other manufacturing waste materials could also be used as a filler in place of or added thereto, for example, recycled plastic products, waste construction material, wood pieces, scrap metal, stone aggregate or concrete. Additionally, a binding agent may be added to form a more cohesive filler material. Examples of the binding agent include, but are not limited to, adhesives, recycled plastics, which can be heated to adhere to the filler surfaces, resins, etc.

I claim:

1. A decorative structure comprising a frame completely surrounding a space and a front and rear barrier material applied to front and rear surfaces of the frame so as to enclose the space and form a three dimensional structure with the space being located between the front and rear barrier material and the frame, said space containing discrete pieces of a loose filler comprising waste glass randomly distributed with open spaces between the discrete pieces, said waste glass having been processed to have smoothened surfaces.

2. The decorative structure of claim 1 wherein the barrier material is a wire mesh.

3. The decorative structure of claim 2 wherein the wire mesh has polygonal openings or circular openings.

4. The decorative structure of claim 1 wherein the waste glass is polished, tumbled or coated with a coloring agent or an agent to enhance the appearance of the surface of the randomly distributed, loose glass filler material.

5. The decorative structure of claim 4 wherein the waste glass is first broken into smaller pieces.

6. The decorative structure of claim 1 wherein no agent is present to bind the randomly distributed discrete pieces of waste glass to adjacent pieces of waste glass.

7. The decorative structure of claim 1 wherein the barrier material is a solid transparent, translucent or opaque material.

8. The decorative structure of claim 1 further including a binding material to secure the randomly distributed discrete pieces of waste glass into a cohesive structure.

9. A decorative structure comprising a frame completely surrounding a space and a front and rear barrier material applied to front and rear surfaces of the frame so as to enclose the space and form a three dimensional structure with the space being located between the front and rear barrier material and the frame, said space containing randomly distributed discrete pieces of a loose filler material with open spaces there between the discrete pieces of loose filler, said filler material having been processed to have an enhanced surface appearance.

10. The decorative structure of claim 9 wherein the filler material comprises one or more of waste glass, construction waste material, wood pieces, scrap metal, stone aggregate, concrete or recycled plastic products.

11. The decorative structure of claim 10 wherein the filler materials are broken or otherwise processed to reduce the size of individual pieces of material and the surfaces of the pieces of filler material are polished or the appearance thereof is enhanced.

12. The decorative structure of claim 11 wherein the barrier material comprises one or more of a wire mesh or a transparent, translucent or opaque material.

13. A method of recycling waste glass generated from the use of glass materials in architectural or construction applications comprising:

collecting multiple pieces of the waste glass and processing the multiple pieces of waste glass to eliminate sharp edges and to provide a glass filler comprising multiple loose pieces material having a modified surface appearance, constructing a box-like structure comprising a frame completely surrounding a space within the box like structure having a front and rear barrier material applied to front and rear surfaces of the frame so as to enclose the space and form a three dimensional structure with the space being located between the front and rear barrier material and the frame, and randomly distributing the multiple pieces of glass filler material into said enclosed space with open spaces between the discrete pieces.

14. The method of claim 13 wherein the waste glass is polished, tumbled or coated with a coloring agent or an agent to enhance the appearance of the surface of the glass filler material.

15. The method of claim 13 wherein the waste glass is first broken into smaller pieces.

16. The method of claim 13 wherein a binding material is added to secure discrete pieces of waste glass into a cohesive open structure.

* * * * *